US006866207B2

(12) United States Patent
Kangas et al.

(10) Patent No.: US 6,866,207 B2
(45) Date of Patent: Mar. 15, 2005

(54) APPARATUS FOR SPRAYING OF LIQUIDS AND SOLUTIONS CONTAINING SOLID PARTICLES SUCH AS PAPER MANUFACTURING FIBERS AND FILLERS

(76) Inventors: Martti Y. O. Kangas, 3067 McCully Dr. NE., Atlanta, GA (US) 30345; Miikka M. Kangas, 3067 McCully Dr. NE., Atlanta, GA (US) 30345

( * ) Notice: Subject to any disclaimer, the term of this patent is extended or adjusted under 35 U.S.C. 154(b) by 0 days.

(21) Appl. No.: 10/455,194

(22) Filed: Jun. 4, 2003

(65) Prior Publication Data

US 2003/0226908 A1 Dec. 11, 2003

Related U.S. Application Data

(60) Provisional application No. 60/385,723, filed on Jun. 5, 2002, and provisional application No. 60/428,782, filed on Nov. 25, 2002.

(51) Int. Cl.[7] ..... B05B 7/10

(52) U.S. Cl. ..... 239/399; 239/290; 239/406; 239/400; 239/422; 239/468; 239/427.5

(58) Field of Search ..... 239/290, 294, 239/301, 399, 403, 406, 463, 468, 472, 482, 490, 491, 400, 405, 422, 427.5, 434.5

(56) References Cited

U.S. PATENT DOCUMENTS

| | | | | | |
|---|---|---|---|---|---|
| 3,790,086 | A | * | 2/1974 | Masai | 239/406 |
| 3,980,233 | A | * | 9/1976 | Simmons et al. | 239/400 |
| 4,431,403 | A | * | 2/1984 | Nowak et al. | 431/183 |
| 5,505,045 | A | * | 4/1996 | Lee et al. | 60/748 |
| 6,260,773 | B1 | * | 7/2001 | Kamath | 239/399 |
| 6,272,840 | B1 | * | 8/2001 | Crocker et al. | 60/776 |
| 6,474,569 | B1 | * | 11/2002 | Brundish et al. | 239/406 |
| 6,729,562 | B2 | * | 5/2004 | Bui | 239/463 |

* cited by examiner

*Primary Examiner*—Binh Q. Tran
(74) *Attorney, Agent, or Firm*—Rodgers & Rodgers

(57) ABSTRACT

A swirling gas atomizer for dispersing liquids and highly viscous or otherwise difficult to disperse solutions of liquids and solids to a mist with desired properties. The pressurized high speed rotating gas in this apparatus can disintegrate most chemical solutions all the way to the finest mist as theorized by Lord Rayleigh in 1882.

8 Claims, 3 Drawing Sheets

APPARATUS FOR SPRAYING OF LIQUIDS AND SOLUTIONS CONTAINING SOLID PARTICLES SUCH AS PAPER MANUFACTURING FIBERS AND FILLERS

The benefits under 35 U.S.C. 119 are claimed of provisional applications 60/385,723, filed Jun. 5, 2002 and 60/428,782, filed Nov. 25, 2002.

FIELD OF THE INVENTION

This invention relates to high consistency paper manufacturing, paper surface treatments, mixing of chemicals, and chemical reactions. In paper manufacturing this invention allows a novel approach to web forming on the paper machines with consistencies reaching up to 15%, when currently only low consistency forming, generally between 0.5% and 1.5% is possible. In mixing of chemicals and their reactions an instant highly reactive large surface area can be provided.

BACKGROUND OF THE INVENTION

According to Lord Rayleigh, a polar liquid, such as water, becomes unstable e.g. during evaporation in droplet form while levitating, when electrostatic forces between its surface become too great for the droplet's surface tension to oppose. The droplet starts to emit fine jet flows until it reaches stability and the jets form a fine fog, called here the Rayleigh Fog. This disintegration starts immediately when the charge exceeds the surface tension, X approaches unity, as defined by the following formula:

$$X=Q^2/[64*\Pi^2*\sigma*\epsilon_0*R^3]\leq 1,$$

where Q=electric charge, $\Pi$=3.14 . . . , $\sigma$=surface tension, R=droplet radius, $\epsilon_0$ material constant.

In a study published in Science News, Jan. 11, 2003, Vol. 163, page 22, this phenomena was captured by a high speed camera, and the observations indicated that a mother droplet instantly formed about 100 daughter droplets, that collectively carried away less than 0.3% of the mass, and ⅓ of the charge.

This specific behavior pattern is fundamental to all spraying processes, and the associated or introduced electric charge is playing a critical role in creating the often undesired aerosols. A solution for this, in the paper industry common aerosol problem, has been presented in the U.S. Pat. No. 4,944,960 by Donnelly, Kangas and Sundholm, with further disclosure in the European Patent EP 0682571 by the same.

Improvement to the existing nozzle technology for difficult to spray liquids used in the paper industry is shown in the recent U.S. patent application Ser. No. 10/057,583 by Kangas and Diebel.

This invention will further improve the above mentioned spraying technology by enhancing the ability to further disintegrate the liquids and solids, and by stabilizing the spray cone diameter within desired propellant pressure ranges for specific liquids. It include a thermal barrier around the propellant cavity eliminating propellant condensation. In this improved spray apparatus the motive gas is forced to circulate at high speed around the exciting liquid jet. The increase of motive gas pressure will increase the rotation speed, and the physical form of the openings will determine the capacity ranges and spray cone opening. The impact of gas to the sprayed liquid resembles what happens in the center of a tornado, however with the ability to control the forces.

To summarize the benefits in brief:

- A high consistency water slurry of paper manufacturing fibers can now for the first time be sprayed directly to form a moving paper web.
- The spraying allows a precise layering/engineering of the papers and boards.
- The required strength in the end-product can now be tailored according to the need allowing the producer to use the most economical raw materials in this process.
- The nozzle allows to complete the new paper manufacturing concept, for which all other key components are already available.
- The environmental problems associated with the high water consumption in the paper mills can be lowered considerably.
- The other paper making materials, chemicals, fillers and coatings can be sprayed using this same nozzle technology.
- This nozzle works also as an efficient chemical reactor and similarly it can be used as an air or oxygen mixer with various fuels.
- The spray droplet size with liquids can be controlled from visible to almost instant Rayleigh Fog.
- At Rayleigh Fog level, the droplets will provide the largest possible almost instant surface area for chemical reactions for the various processes.

BRIEF SUMMARY OF THE INVENTION

According to this invention, an apparatus creates a continuous seamless spray of the desired liquid using a specially designed nozzle as described in this invention utilizing any single gas, steam, air or a mixture of thereof as a motive gas or propellant.

The improvements to the current technology result from the ability to more completely disintegrate the liquids in a very short time span as desired, while retaining the spray cone opening angle constant. This liquid disintegration is achieved with low energy consumption using the motive gas as propellant. Almost any liquid or material that can be pumped, with or without embedded solids, can be disintegrated with a propellant pressure below 10 atmospheres. The typical propellant pressures e.g. in the paper making environment will vary from 0.2 to 1.5 atmospheres.

The liquid flow through the nozzle can be fine-tuned using the motive gas pressure, while the form of the spray cone will not change in this process when conditions are kept within the design parameters for a specific nozzle and liquid.

The system may have an optional specific orifice inside the intake piping between the nozzle and the liquid distribution pipe as described. The gas spin generator assembly is located inside the nozzle housing and contains optionally the means for a reagent or a coolant addition around the center pipe in the nozzle. Depending on the application the center nozzle is tailored to suit the application in material, tip shape and length.

DETAILED DESCRIPTION OF THE INVENTION

Figure 1:
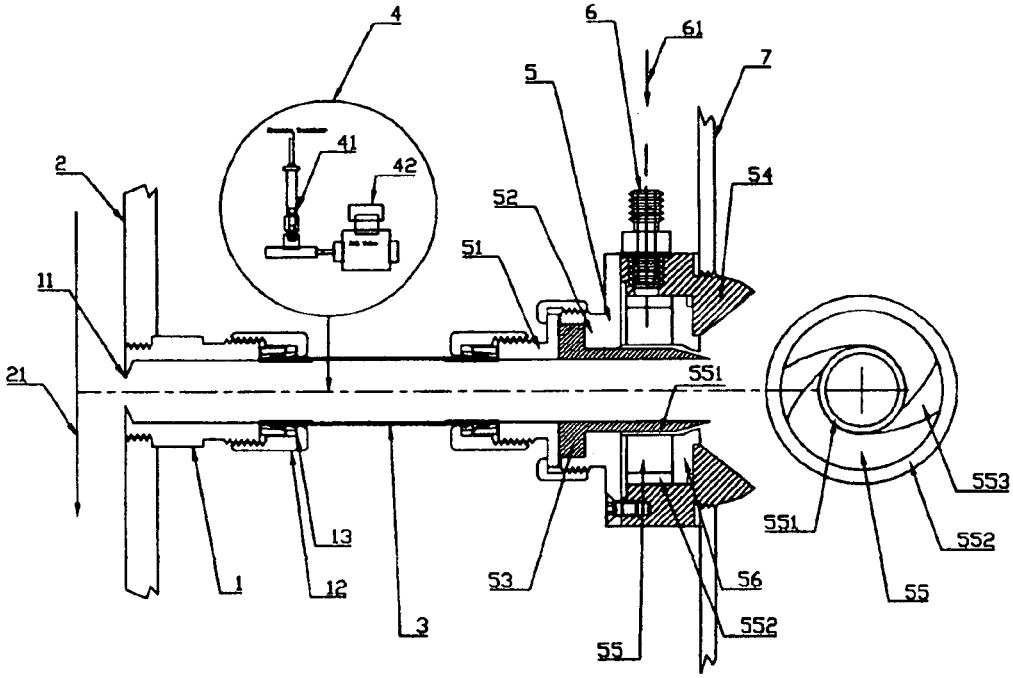
FIG. 1 is a nozzle assembly, showing the sectional view of the nozzle starting from the optional orifice, and a top view of a typical tangential whirling gas generator, inner nozzle, and the outlet structures of the cone protector.

The atomizing apparatus hereinafter referred to as the swirling gas atomizer, shown in FIG. 1 comprises a substantially cylindrical housing or orifice assembly 1 with an intake orifice 11, which receives a flow of liquid 21 from a larger main distribution pipe. Attached to the distribution pipe wall 2, is a substantially cylindrical nozzle assembly 5. Teflon tubing 3 connect orifice assembly 1 to substantially cylindrically nested nozzle assembly 5 using tubing attachments 12 and gaskets 13 at each end. An optional flow controller assembly 4 is attached between orifice assembly 1 and Teflon tubing 3 and comprises a by itself optional pressure indicator 41 and a by itself optional control valve 42. First nozzle element 6 receives propellant gas 61 into the nozzle assembly 5.

Figure 2:
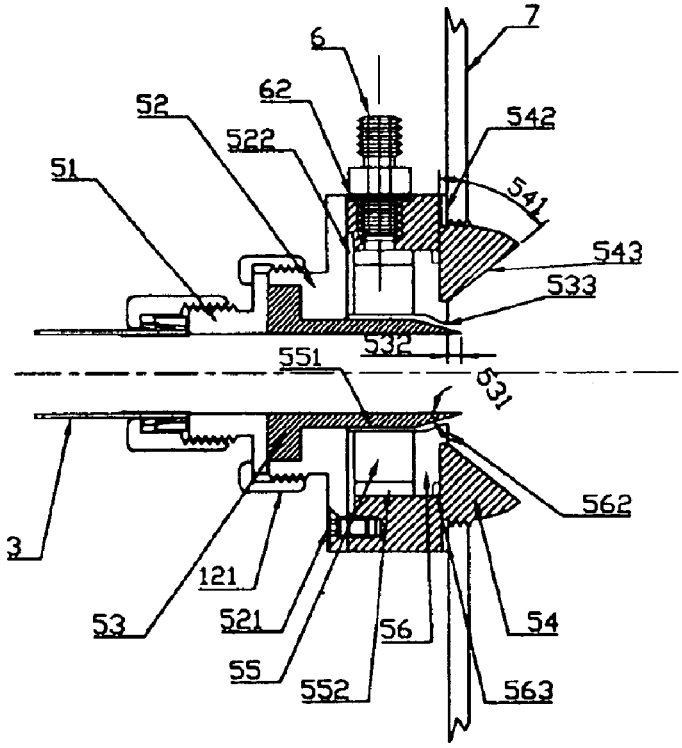
FIG. 2 is an enlargement of the nozzle assembly.

Nozzle assembly 5 is substantially cylindrically nested around the extended tubing 3 axis shown in FIG. 2 and FIG. 1 comprises substantially cylindrical tubing end piece 51 that is attached by threads to the nozzle support 52 at one end and to tubing 3 at the other end using attachment 12 and gasket 13 which transfers liquid 21 flow to nozzle assembly 5. Substantially cylindrical nozzle support 52 holds the assembly together using nozzle support screw(s) 521 and nut 121 to attach to protector cone 54 and gasket 522 for separation and insulation from swirl wheel 55. Substantially cylindrical inner nozzle 53 whose design of inner nozzle angle 531 and inner nozzle adjustment 532 impact the spray pattern of the liquid 21 together with the air or gas flow from first nozzle element 6 guided by the converging/diverging nozzle design 533. Substantially cylindrical protector cone 54 guides the counter air current and is attached by threads and gasket 542 to nozzle support plate 7. Cone angle 541 and cone wall length 543 are designed specifically for each application and substantially cylindrical swirl wheel 55 gives the spin and speed to the spray pattern using the air or motive gas 61 entering through first nozzle element 6 and is attached to protector cone 54 by threads and gasket 62. Continuing through swirl wheel 55 via cylindrical cavity 552 are one or several pressure balancers 553, and cylindrical inner cavity 551. Swirl wheel 55 has a substantially cylindrical cone former 56 attached, whose swirl ledge 562 design is important for the spray formation. Gasket 563 seals cone former to protector cone 54.

Figure 3:
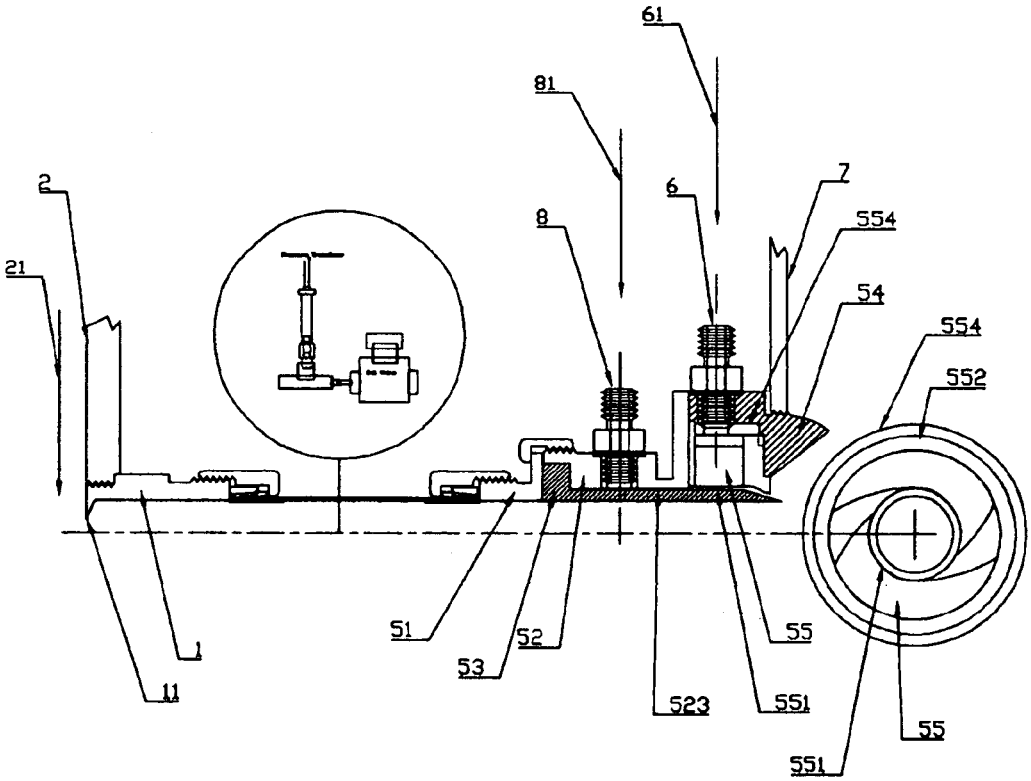
FIG. 3 is a nozzle assembly showing the means to add chemical reagent or coolant to the outside of the inner nozzle.

The swirling gas atomizer can also be equipped by a second nozzle element 8 which receives coolant, lubricant, or reagent 81 into the nozzle assembly 5 of FIG. 3. This version of the atomizing apparatus is similar to the one shown in FIG. 1 except substantially cylindrical nozzle support 52 is elongated to allow the attachment of a second nozzle element 8 to nozzle support 52 by threads and gasket additionally allowing a cylindrical cavity 523 between 52 and elongated inner nozzle 53 to transfer coolant, lubricant, or reagent 81 into the cylindrical inner cavity 551. The swirl wheel 55 can additionally be equipped by surrounding isolation/insulation ring 554 to form a thermal barrier cavity that can also be applied in the above setting shown in FIG. 1.

What is claimed is:

1. An atomizer for paper making comprising elongated tubing, an intake orifice disposed on one end of said tubing, a nozzle assembly affixed to the opposite end of said tubing, a first nozzle element extending from said nozzle assembly at an angle with respect to the axis of said tubing, a swirl wheel and cone former concentrically disposed with respect to said tubing and adopted to receive propellant gas from said first nozzle element, and said cone former comprising a swirl ledge angled inwardly with respect to said axis of said tubing.

2. An atomizer according to claim 1 wherein a cylindrical nozzle is concentrically disposed with respect to said tubing of said opposite end and comprises a convergent/divergent nozzle design.

3. An atomizer according to claim 1 wherein a protector cone is affixed to said opposite end.

4. An atomizer according to claim 1 wherein a second nozzle element extends from said nozzle assembly and in generally parallel to said first nozzle element.

5. An atomizer according to claim 3 wherein the whirl wheel and cone former, inner nozzle, gasket and isolation/insulation ring of thermal barrier material form a cavity to receive the propellant gas.

6. An atomizer according to claim 4 wherein the whirl wheel and cone former, inner nozzle, gasket and isolation/insulation ring of thermal barrier material form a cavity to receive the propellant gas.

7. An atomizer comprising elongated tubing, an intake orifice disposed on one end of said tubing, a nozzle assembly affixed to the opposite end of said tubing, a first nozzle element extending from said nozzle assembly at an angle with respect to the axis of said tubing, a swirl wheel and cone former concentrically disposed with respect to said tubing and adopted to receive propellant gas from said first nozzle element, a protector cone affixed to said opposite end, and the whirl wheel and cone former, inner nozzle, gasket and isolation/insulation ring of thermal barrier material forming a cavity to receive the propellant gas.

8. An atomizer comprising elongated tubing, an intake orifice disposed on one end of said tubing, a nozzle assembly affixed to the opposite end of said tubing, a first nozzle element extending from said nozzle assembly at an angle with respect to the axis of said tubing, a swirl wheel and cone former concentrically disposed with respect to said tubing and adopted to receive propellant gas from said first nozzle element, a second nozzle element extending from said nozzle assembly and generally parallel to said first nozzle element, and the whirl wheel and cone former, inner nozzle, gasket and isolation/insulation ring of thermal barrier material forming a cavity to receive the propellant gas.

* * * * *